US005951331A

United States Patent [19]

Li-Ming et al.

[11] Patent Number: 5,951,331

[45] Date of Patent: Sep. 14, 1999

[54] PRESSURE ABSORBING CONTACT AND CONNECTOR USING THE SAME

[75] Inventors: Pai Li-Ming; Yu-San Hsiao, both of Tu-Chen; Liu Jia Hung, Hsin-Chuang, all of Taiwan

[73] Assignee: Hon Hai Precision Ind. Co., Ltd., Taipei Hsien, Taiwan

[21] Appl. No.: 09/041,935

[22] Filed: Mar. 13, 1998

[30] Foreign Application Priority Data

Mar. 13, 1997 [TW] Taiwan ..... 86204065

[51] Int. Cl.[6] ..... H01R 13/10

[52] U.S. Cl. ..... 439/682; 439/862

[58] Field of Search ..... 439/660, 862, 439/733.1

*Primary Examiner*—Neil Abrams
*Assistant Examiner*—J. F. Duverne

[57] ABSTRACT

A pressure absorbing contact includes an engaging portion for fixing in a spaced passageway of a connector. A pressure absorbing portion perpendicularly and obliquely extends from the engaging portion. An elastic curved contacting portion extends from the pressure absorbing portion and includes a contacting surface for electrically contacting an externally inserted contact. A frictional force between the contacting surface of the pressure absorbing contact and the externally inserted contact is considerably eliminated by deformation of the pressure absorbing portion and the elastic curved contacting portion upon application of the frictional force on the contacting surface of the pressure absorbing contact.

12 Claims, 7 Drawing Sheets

PRESSURE ABSORBING CONTACT AND CONNECTOR USING THE SAME

BACKGROUND OF THE INVENTION

1. Field of The Invention

The present invention relates to a pressure absorbing contact and a connector using the same, and particularly to an electrical contact which can absorb insertion pressure (friction) from a corresponding male contact of an external complementary connector thus considerably eliminating removal of gold coated thereon upon insertion of the complementary connector into the related connector in which a plurality of the same absorbing contacts are installed.

2. The Prior Art

Complementary connector assemblies are frequently used for board to board connection in an electrical assembly. Conventional complementary connector assemblies usually include a male connector and a female connector defining two openings allowing the male connector to be inserted therein from two directions corresponding to the two openings. For example, U.S. Pat. No. 4,632,475 discloses complementary connectors, wherein the male connector has a plurality of integral contacts and the female connector includes a plurality of spaced passageways which respectively and securely retain U-shaped contacts therein. Each integral contact of the male connector is mechanically enclosed by and electrically engaged with a corresponding U-shaped contact of the female connector when the male connector is engaged with the female connector. However, the fabrication of the U-shaped contact of the female connector requires a considerable amount of raw materials which increases manufacturing costs. Another disadvantage is that the large engagement area between the integral contact of the male connector and the U-shaped contact of the female connector combined with a shortage of contact elasticity therebetween usually erodes the gold-coated surface of the contacts which accordingly increases oxidization on the contacts thereby deteriorating the conductive effect between the two connectors.

Another example is disclosed in U.S. Pat. No. 5,551,883, wherein a male connector has an integral contact while a female structure has an improved contact which has an inclined elastic arm having a protrusion for replacing the contacting method disclosed in U.S. Pat. No. 4,632,475. The elastic arm of the improved contact made by a stamping process has a curved portion extending from an engaging portion (a plate with barbs) thereof for providing elasticity to the gold-coated contacting section. However, the elasticity insufficiently eliminates the erosion of the coated gold, thus the engaging portion of each contact has to be interferentially fit within the corresponding housing cavity wall in order to obtain pre-pressure therefrom for facilitating insertion of the corresponding male contact. Therefore, when the elastic contacts of the female connector are installed in the corresponding housing passageway, drawbacks such as time inefficiency and lower yield will invariably result. Other disclosures such as U.S. Pat. Nos. 4,715,819 and 4,975,062 encounter the same problems.

Therefore, it is requisite to provide a new structure for elastic contacts to solve the mentioned problems in order to promote electrical engagement efficiency.

SUMMARY OF THE INVENTION

The primary purpose of the present invention is to provide a new structure for a pressure absorbing contact and a connector using the same wherein the gold coated thereon will remain when a corresponding male contact installed in a complementary connector is inserted thereinto to electrically engage with the pressure absorbing contact.

In accordance with one aspect of the present invention, a pressure absorbing contact comprises an engaging member for engaging with an inner wall portion of a passageway defined in a connector housing; a pressure absorbing member connected to the engaging member; and an elastic contacting member connected to the pressure absorbing member and including a contacting surface for electrically connecting to an externally inserted contact and receiving a frictional force from the inserted contact. The elastic contacting member deforms upon receiving the frictional force from the external contact for releasing a first portion of the friction and simultaneously transmits a second portion of the frictional force to the pressure absorbing member which in turn deforms for releasing the second portion of the frictional force.

In accordance with another aspect of the present invention, an electrical connector comprises an insulative housing including a first surface, a second surface connected to the first surface, a third surface connected to the second surface opposite the first surface, and a plurality of spaced passageways each communicating with the first, second, and third surfaces. A plurality of pressure absorbing contacts are respectively received and retained in the corresponding passageways.

Each pressure absorbing contact comprises an engaging member for engaging with an inner wall portion of the passageway defined in the insulative housing; a pressure absorbing member connected to the engaging member; and an elastic contacting member connected to the pressure absorbing member and including a contacting surface for electrically connecting to an externally inserted contact and receiving a frictional force from the inserted contact. The elastic contacting member deforms upon receiving the frictional force from the external contact for releasing a first portion of the frictional force and simultaneously transmits a second portion of the frictional force to the pressure absorbing member which in turn deforms for releasing the second portion of the frictional force.

DETAILED DESCRIPTION OF THE PREFERRED EMBODIMENT

Figure 1:
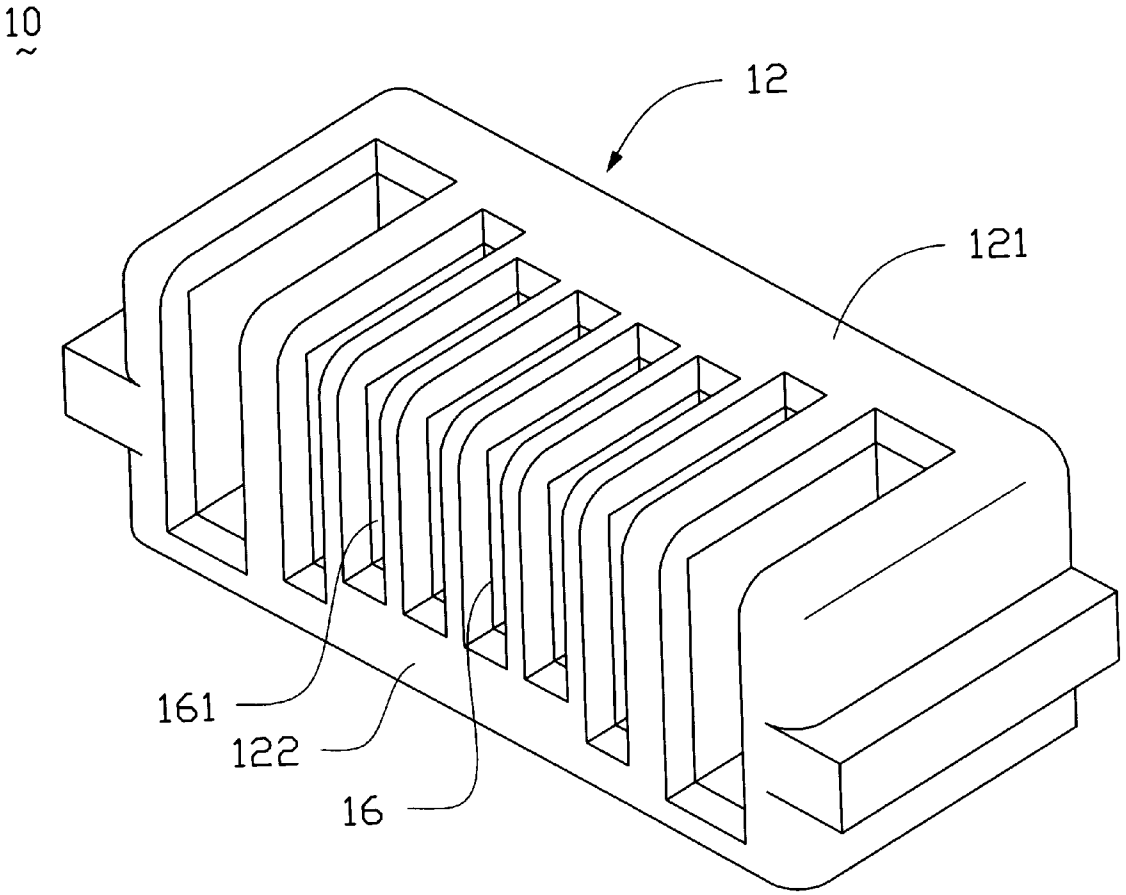
FIG. 1 is a perspective front view of a electrical connector in accordance with the present invention.
Figure 2:
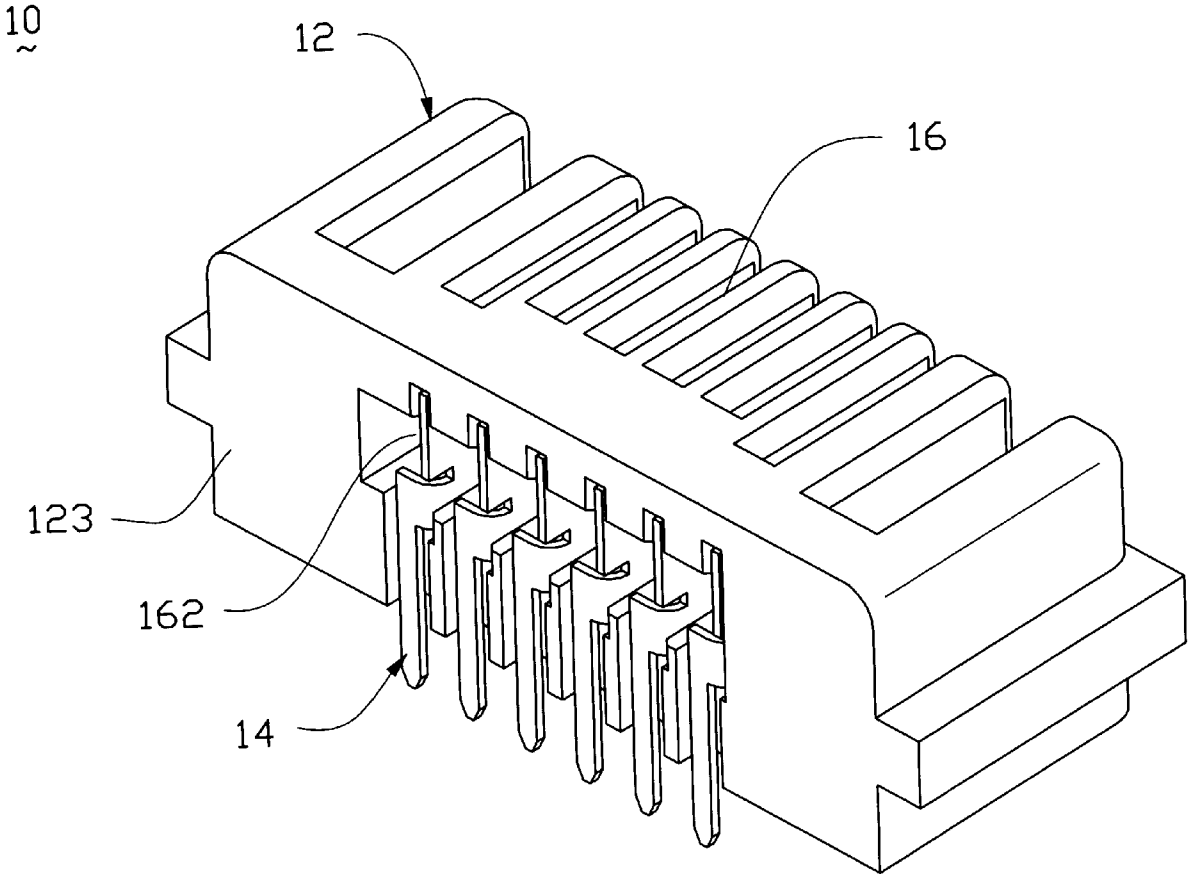
FIG. 2 is a perspective rear view of the electrical connector of FIG. 1.

Referring to the drawings and initially to FIGS. 1 and 2, an electrical connector 10 in accordance with the present invention comprises an insulative housing 12 and a plurality of contacts 14 received in the insulative housing 12. The insulative housing 12 comprises a first surface 121 substantially at a top portion thereof, a second surface 122 substantially at a front portion thereof, a third surface 123 substantially at a rear portion opposite the second surface 122, and a plurality of spaced passageways 16 in communication with the first, second, and the third surfaces 121, 122, 123. More specifically, each passageway 16 includes a first opening 161 exposed to the first and the second surfaces 121 and 122, and a second opening 162 exposed to the third surface 123. Each contact 14 is inserted into the insulative housing 12 through a corresponding second opening 162 using a well known assembly procedure.

Figure 3:
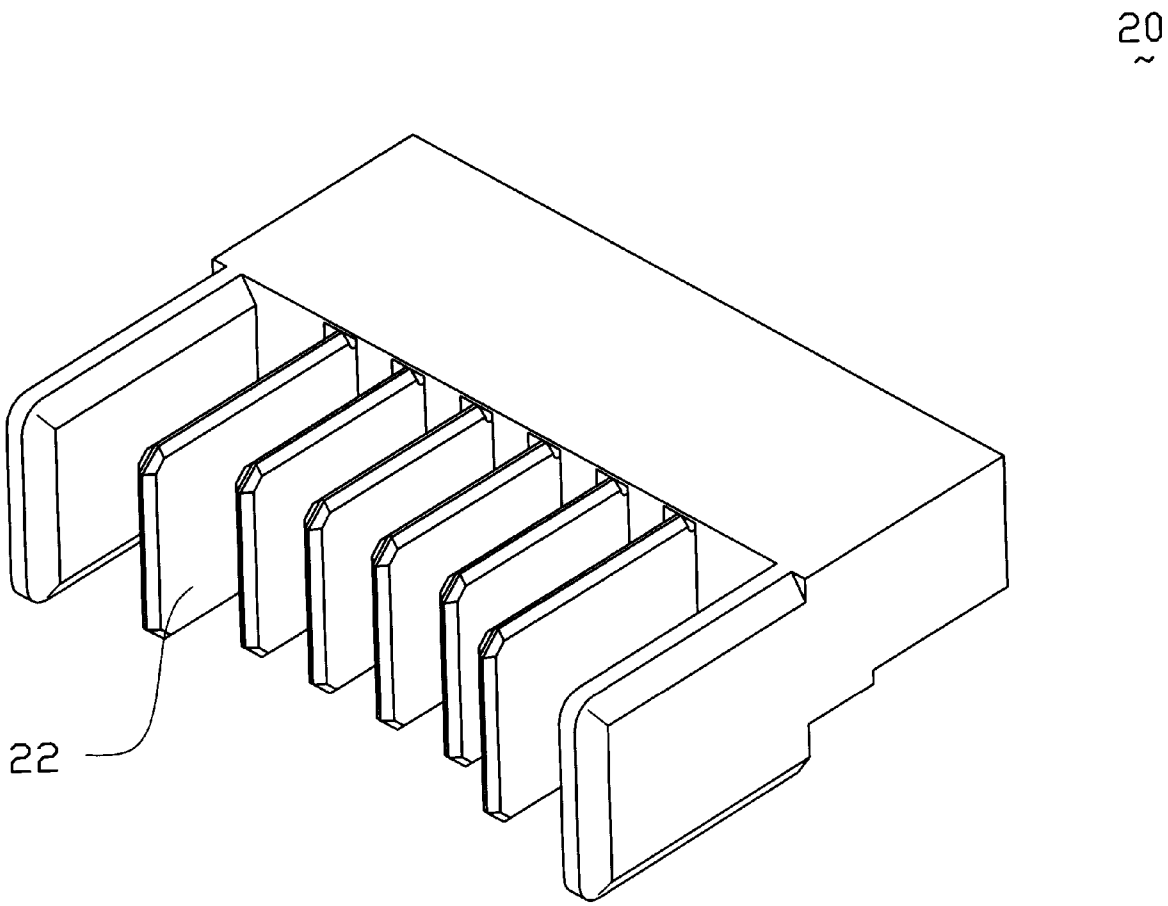
FIG. 3 is a perspective view of a complementary connector or mating with the electrical connector of the present invention.

Also referring to FIG. 3, an external complementary connector 20 including male contacts 22 is inserted into the electrical connector 10 through the first openings 161 thereof.

Figure 4:
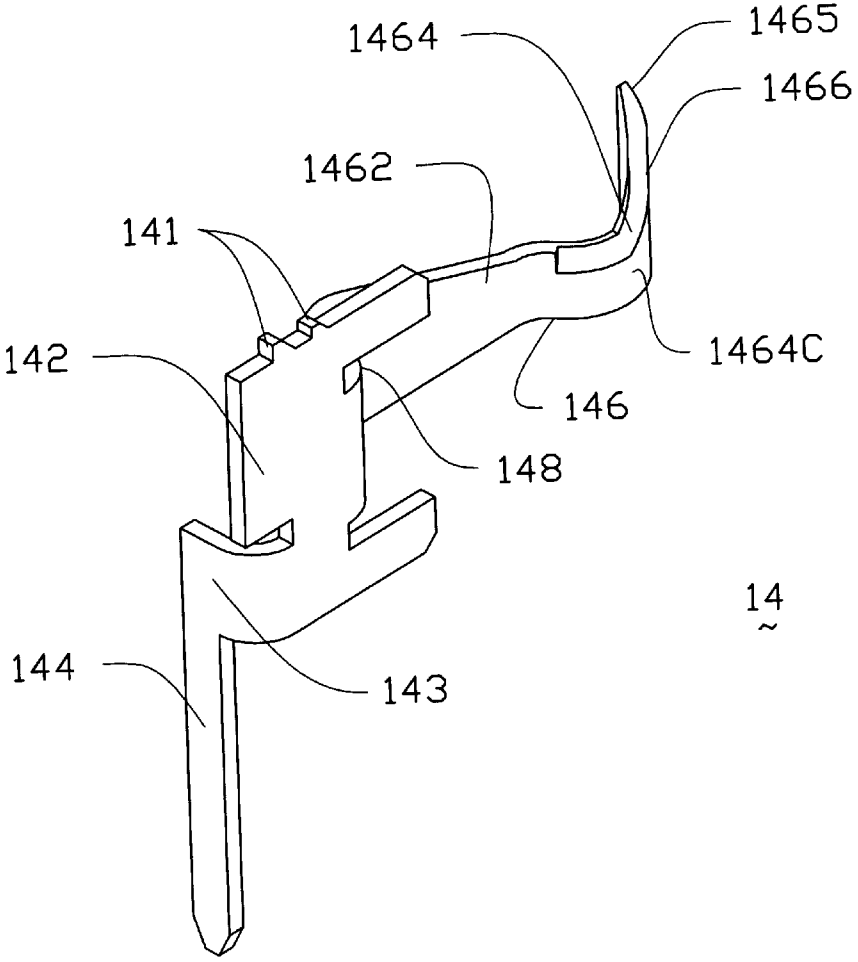
FIG. 4 is a perspective view of a contact in accordance with the present invention.

FIG. 4 illustrates a detailed structure of the contact 14 which has an engaging portion 142 sized to be retained in a corresponding passageway 16 of the insulative housing 12. The engaging portion 142 has two barbs 141 formed on one side thereof for further engagement in the passageway 16. The barbs 141 are arranged to interferentially fit with an inner wall portion (not labeled) of the insulative housing 12.

Figure 5:
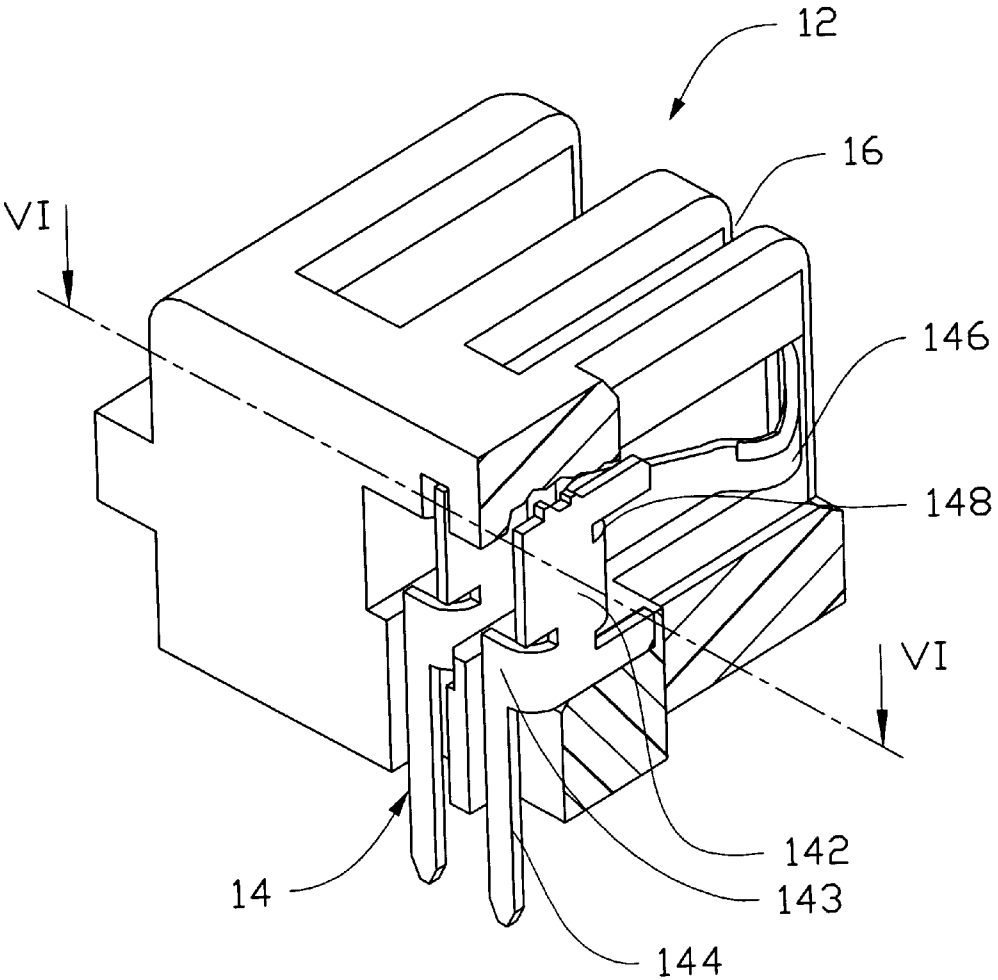
FIG. 5 is a partial perspective view illustrating the contact of FIG. 4 installed in the connector.

The contact 14 is firmly retained in the passageway 16 as seen in FIG. 5, wherein part of the inner wall portion which engages the barbs 141 of the contact 14 is removed to clearly show the barbs 141. The engagement therebetween can be seen in FIG. 7.

Referring back to FIGS. 4 and 5, a deformable pressure absorbing portion 148 of the contact 14 extends perpendicularly and obliquely from one side of the engaging portion 142. A stop portion 143 extends perpendicularly from an opposite side of the engaging portion 142 for abutting a wall portion (not shown) of the third surface 123 when the contact 14 is installed into the passageway 16, and a soldering portion 144 extends downward from the stop portion 143 for being mounted to and soldered on an external printed circuit board (not shown). An elastic contacting portion 146 obliquely extends from the pressure absorbing portion 148 and is substantially perpendicular to a lengthwise direction of the soldering portion 144. The elastic contacting portion 146 includes a first curved plate section 1462 integrally connected to a second curved plate section 1464 which has a contacting surface 1464C coated with gold for electrically contacting with the male contact 22 of the complementary connector 20. The curved plate sections 1462, 1464 can absorb a frictional force applied to the contacting surface 1464C upon insertion of the male contact 22 of the complementary connector 20. The second curved plate section 1464 has an edge with an inclined surface 1466 and an extended acute corner 1465 therealong for smoothly guiding the insertion of the male contact 22 of the complementary connector 20 into the corresponding passageway 16 of the housing 12.

Figure 6:
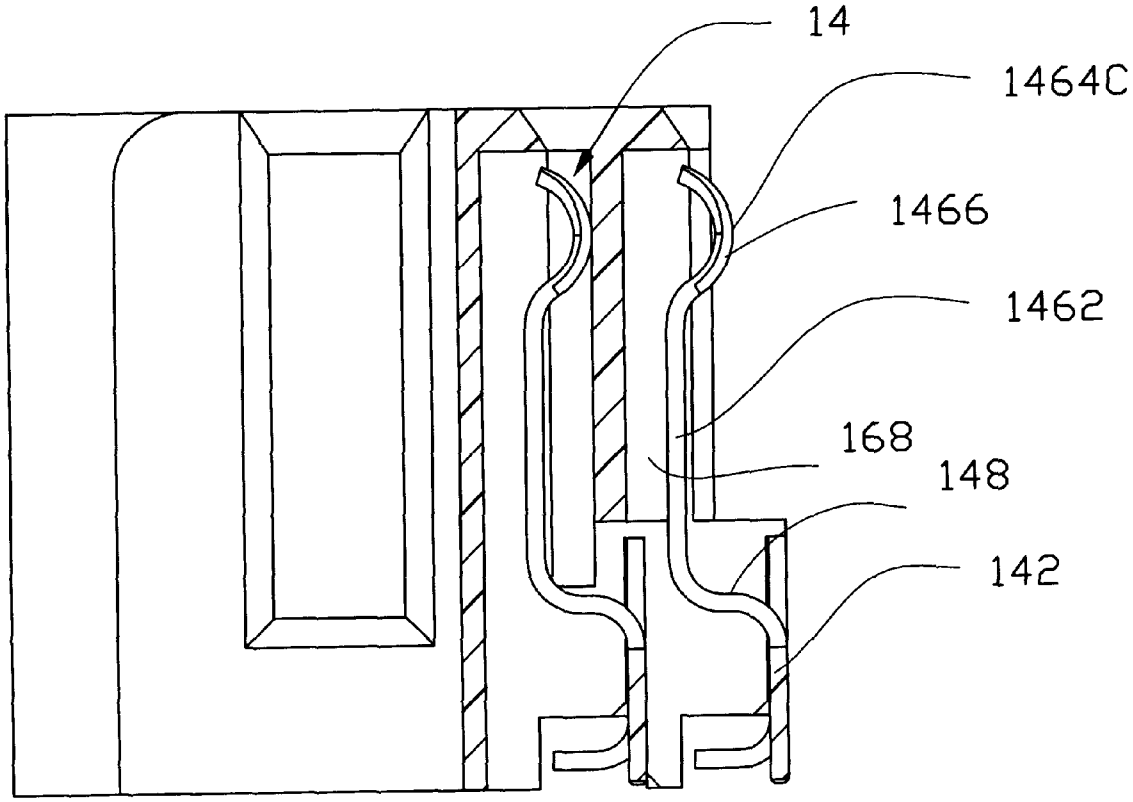
FIG. 6 is a partial cross-sectional view taken along line VI—VI of FIG. 5 illustrating the engagement of the contacts with the passageways of the electrical connector.

FIG. 6 shows a space 168 of the passageway 16 which allows the first curved plate section 1462 together with the pressure absorbing portion 148 to be elastically deformed therein upon insertion of a corresponding male contact 22 of the complementary connector 20.

Figure 7:
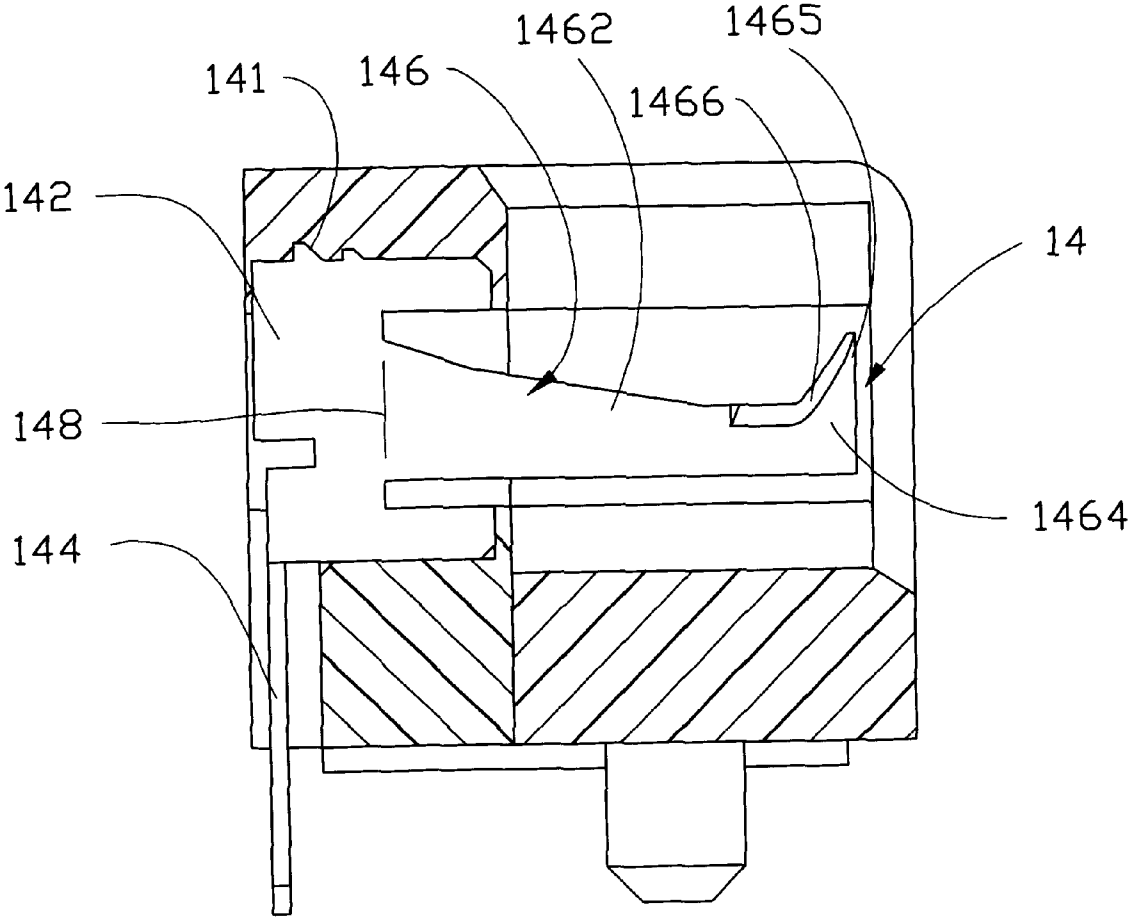
FIG. 7 is a side elevational view of FIG. 5.

Referring to FIG. 7, the first curved plate section 1462 of the elastic contacting portion 146 of the contact 14 is substantially tapered from a first end connected to the pressure absorbing portion 148 to a second end connected to the second curved plate section 1464, i.e., it has a relatively wide portion adjacent to the pressure absorbing portion 148 and a relatively narrow portion adjacent to the second curved plate section 1464. With this structure, the insertion pressure from the male contact 22 of the connector 20 can be quickly transmitted to the pressure absorbing portion 148 thus the pressure on the contacting surface 1464C of the second curved plate section 1464 can be considerably released and the gold coated thereon can be preserved during insertion of the male contact 22.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claims:

1. A pressure absorbing contact comprising:

an engaging member for engaging with an inner wall portion of a passageway defined in a connector housing;

a pressure absorbing member connected to the engaging member; and an elastic contacting member connected to the pressure absorbing member and including a contacting surface for electrically connecting to an externally inserted contact and receiving a frictional force from the inserted contact;

whereby the elastic contacting member deforms upon receiving the frictional force from the external contact for releasing a first portion of the frictional force and simultaneously transmits a second portion of the frictional force to the pressure absorbing member which in turn deforms for releasing a second portion of the frictional force.

2. The pressure absorbing contact as claimed in claim 1, wherein the engaging member is an engaging plate including at least a barb extending therefrom for engagement with the inner wall portion of the passageway defined in the connector housing.

3. The pressure absorbing contact as claimed in claim 2, wherein the pressure absorbing member is a pressure absorbing plate perpendicularly and obliquely extending from one edge of the engaging plate, thus when a frictional force is applied to the contacting surface of the elastic contacting member, a portion thereof is released via deformation of the pressure absorbing plate.

4. The pressure absorbing contact as claimed in claim 2, wherein the elastic contacting member comprises a first curved plate section connected to the pressure absorbing member and a second curved plate section connected to the first curved plate section, with the contacting surface of the elastic contacting member positioned in a joint section between the first and second curved plate sections, therefore when a frictional force is applied to the contacting surface of the elastic contacting member, a portion thereof is released via deformation of the first and second curved plate sections.

5. The pressure absorbing contact as claimed in claim 4, wherein the first curved plate section is substantially tapered from the connection with the pressure absorbing member to the connection with the second curved plate section in order to simultaneously transmit a portion of the pressure to the pressure absorbing member upon application of a frictional force onto the contacting surface of the elastic contacting member.

6. The pressure absorbing contact as claimed in claim 4, wherein the second curved plate section has an edge with an inclined surface and an extended acute corner therealong for smoothly guiding the externally inserted contact upon initial insertion thereof.

7. An electrical connector comprising:

an insulative housing including a first surface, a second surface connected to the first surface, a third surface connected to the second surface opposite the first surface, and a plurality of spaced passageways each communicating with the first, second, and third surfaces and a plurality of pressure absorbing contacts each received and retained in a corresponding passageway defined in said insulative housing;

the improvement comprising:

each said pressure absorbing contact comprising:

an engaging member for engaging with an inner wall portion of a corresponding passageway defined in the housing;

a pressure absorbing member connected to the engaging member; and an elastic contacting member connected to the pressure absorbing member and including a contacting surface for electrically connecting to an externally inserted contact and receiving a frictional force from the inserted contact;

whereby the elastic contacting member deforms upon receiving the frictional force from the external contact for releasing a first portion of the frictional force and simultaneously transmits a second portion of the friction force to the pressure absorbing member which in turn deforms for releasing the second portion of the friction force.

8. The electrical connector as claimed in claim 7, wherein the engaging member is an engaging plate including at least a barb extending therefrom for engagement with the inner wall portion of the passageway defined in the connector housing.

9. The electrical connector as claimed in claim 8, wherein the pressure absorbing member is a pressure absorbing plate perpendicularly and obliquely extending from one edge of the engaging plate, thus when a frictional force is applied on the contacting surface of the elastic contacting member, a portion thereof is released via deformation of the pressure absorbing plate.

10. The electrical connector as claimed in claim 8, wherein the elastic contacting member comprises a first curved plate section connected to the pressure absorbing member and a second curved plate section connected to the first curved plate section, with the contacting surface of the elastic contacting member positioned in a joint section between the first and second curved plate sections, therefore when a frictional force is applied on the contacting surface of the elastic contacting member, a portion thereof is released via deformation of the first and second curved plate sections.

11. The electrical connector as claimed in claim 10, wherein the first curved plate section is substantially tapered from the connection with the pressure absorbing member to the connection with the second curved plate section in order to simultaneously transmit a portion of the pressure to the pressure absorbing member upon application of the frictional force on the contacting surface of the elastic contacting member.

12. The electrical connector as claimed in claim 10, wherein the second curved plate section has an edge with an inclined surface and an extended acute corner therealong for smoothly guiding the externally inserted contact upon initial insertion thereof.

* * * * *